US006005207A

United States Patent [19]

DiMarco et al.

[11] Patent Number: 6,005,207

[45] **Date of Patent: *Dec. 21, 1999**

[54] MULTI-PART CIRCUIT BREAKER HOUSING

[75] Inventors: Bernard DiMarco; David A. Leone; Bruce D. Guiney, all of Lilburn; Neal Reeves, Atlanta, all of Ga.

[73] Assignee: Siemens Energy & Automation, Inc., Alpharetta, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 08/935,754

[22] Filed: Sep. 23, 1997

[51] Int. Cl.[6] ..... H01H 9/02

[52] U.S. Cl. ..... 200/303; 335/132

[58] Field of Search ..... 218/22, 25, 26, 218/41, 154, 155; 335/8, 9, 10, 16, 147, 195, 202; 200/303

[56] References Cited

U.S. PATENT DOCUMENTS

| | | | |
|---|---|---|---|
| 2,908,782 | 10/1959 | Kiesel et al. | 200/88 |
| 3,464,038 | 8/1969 | Murai et al. | 335/16 |
| 4,206,335 | 6/1980 | Kummerow et al. | 200/303 |
| 4,409,572 | 10/1983 | Mostosi | 335/8 |
| 4,527,027 | 7/1985 | Link et al. | 200/144 |
| 4,559,423 | 12/1985 | Yamagata et al. | 200/144 R |
| 4,595,896 | 6/1986 | DiMarco et al. | 335/202 |
| 4,620,076 | 10/1986 | Mrenna et al. | 200/304 |
| 4,698,606 | 10/1987 | Mrenna et al. | 335/45 |
| 4,760,226 | 7/1988 | Fasano | 200/303 |
| 4,812,793 | 3/1989 | Krasij | 335/8 |
| 4,876,424 | 10/1989 | Leone et al. | 200/306 |
| 4,882,556 | 11/1989 | Fujii et al. | 335/8 |
| 4,899,253 | 2/1990 | Buxton | 361/376 |
| 4,939,491 | 7/1990 | Nissly et al. | 335/18 |
| 4,975,667 | 12/1990 | Morgan et al. | 335/202 |
| 5,084,689 | 1/1992 | Morgan et al. | 335/202 |
| 5,117,211 | 5/1992 | Morgan et al. | 335/202 |
| 5,231,365 | 7/1993 | Kato | 335/132 |
| 5,278,531 | 1/1994 | Link et al. | 335/202 |
| 5,440,088 | 8/1995 | Coudert et al. | 200/303 |

*Primary Examiner*—Michael L. Gellner
*Assistant Examiner*—Nhung Nguyen

[57] ABSTRACT

A circuit breaker housing includes a base having a main portion and a separate subbase portion. The line contact arms for the breaker are mounted on the subbase portion and attached to the main portion which includes the load contact arms. The main portion of the base includes a bottom wall which insulates the load contact arms from the line contact arms along a portion of their lengths. In addition, the bottom wall forms a structural member which rigidly ties the two sidewalls of the main portion of the base. The bottom wall of the main portion of the base includes an opening through which line contacts coupled to the line contact arm make contact with load arm contacts coupled to the load contact arms. Adjacent to the opening, the main portion of the base includes vertical ribs directly tied to the bottom wall which strengthen internal and external side walls in the main portion of the base and reinforce the structural member formed by the bottom wall of the main portion of the base. The subbase may be attached to the base with screws, adhesives, a combination of screws and adhesives or by other methods.

17 Claims, 7 Drawing Sheets

MULTI-PART CIRCUIT BREAKER HOUSING

BACKGROUND OF THE INVENTION

The present invention relates generally to the housing for a circuit breakers and in particular to a housing which includes a base having improved structural characteristics and a subbase which allows easy assembly of the breaker.

A conventional circuit breaker comprises several components including source and load side terminals, a line strap, a movable load contact arm, a latch mechanism which is used to manually open an close the breaker and an electromagnetic tripping device which operates in response to an overcurrent flowing through the load contact arm and line strap to trip the latch and open the breaker. For circuit breakers which protect three-phase circuits, all of these components except for the latch are duplicated three times.

The assembly of a conventional circuit breaker may be a complex task because some of these components overlay other components in the breaker housing. Because high currents are involved, each of the component parts of the circuit breaker is typically mounted in the breaker housing with tight tolerances. For example, in many breakers it is desirable for the principal current carrying components, the load contact arm and the line strap, to be parallel and in close proximity along at least a portion of their length and yet insulated from each other. This construction enables these breaker components to generate the strong magnetic repulsive forces that are used to "blow-open" the connection between the load and line contacts during a large overcurrent condition. In many existing breakers this structure is achieved by applying insulation directly over each line strap and then assembling the load contact arm directly over the insulation.

The assembly requirements of a circuit breaker contribute directly to its cost. Accordingly, it is desirable to design a circuit breaker to simplify its assembly as much as possible.

One way in which assembly may be simplified is to provide more open space in the circuit breaker housing. A relatively open housing may allow at least some components to be assembled before they are inserted into the housing. In addition, components close to the bottom of the housing, for example, the line straps, may be inserted more easily if the circuit breaker housing has open space through which these components may be guided to their destinations.

The insertion of the line contact arms or line straps into a circuit breaker housing may be particularly difficult because these components often have shapes which bend back upon themselves. The line contact arms are shaped so that the line and load terminals may be on opposite sides of the breaker but also, for blow-open operation, so that at least a portion of the line contact arm may be parallel to a corresponding portion of the load contact arm. For the blow-open mechanism to work properly, the current flow through the parallel portion of the load contact arm should be in the opposite direction to the current flow through the corresponding parallel portion of the line strap. These line straps are typically in the bottom of the breaker housing and include a line terminal which is accessible from outside the circuit breaker housing. Thus, in many existing breakers, the line straps are dropped into the bottom of the housing and then maneuvered to push the line terminal through a slot in the side of the circuit breaker.

In conventional circuit breakers, there is often a tradeoff between ease of assembly and structural integrity. If a circuit breaker housing is designed with too much open space, it may not be strong enough structurally to withstand the normal forces to which the circuit breaker is subject to during installation and use, especially forces generated when the breaker is subject to heavy short-circuit currents. During a heavy short-circuit condition, electrical arcing which occurs when the line contact is separated from the load contact may cause an explosive rise in pressure inside the breaker housing.

SUMMARY OF THE INVENTION

The present invention is embodied in a circuit breaker housing having multiple sections including a base and a subbase. The base includes a bottom wall having an opening through which a movable load contact arm may project to make contact with a line contact arm. The wall provides insulation between parallel portions of the load contact arm and the line contact arm and provides a tie between side walls of the housing to enhance the structural integrity of the housing. The subbase includes a pocket which holds the line contact arm and is attached to the base such that a line contact at the end of the line contact arm is directly beneath the opening in the bottom wall of the base.

According to another aspect of the invention, the base includes vertical ribs, adjacent to the opening in the bottom wall connecting and strengthening the bottom wall and the side walls.

According to yet another aspect of the invention, the subbase has at least two pockets which hold respective line contact arms and has a partial wall, between the line contact arms, which includes a feature that mates with a corresponding feature on a respective partial wall in the base to form an insulating wall between the two line contact arms.

DETAILED DESCRIPTION

Figure 1:
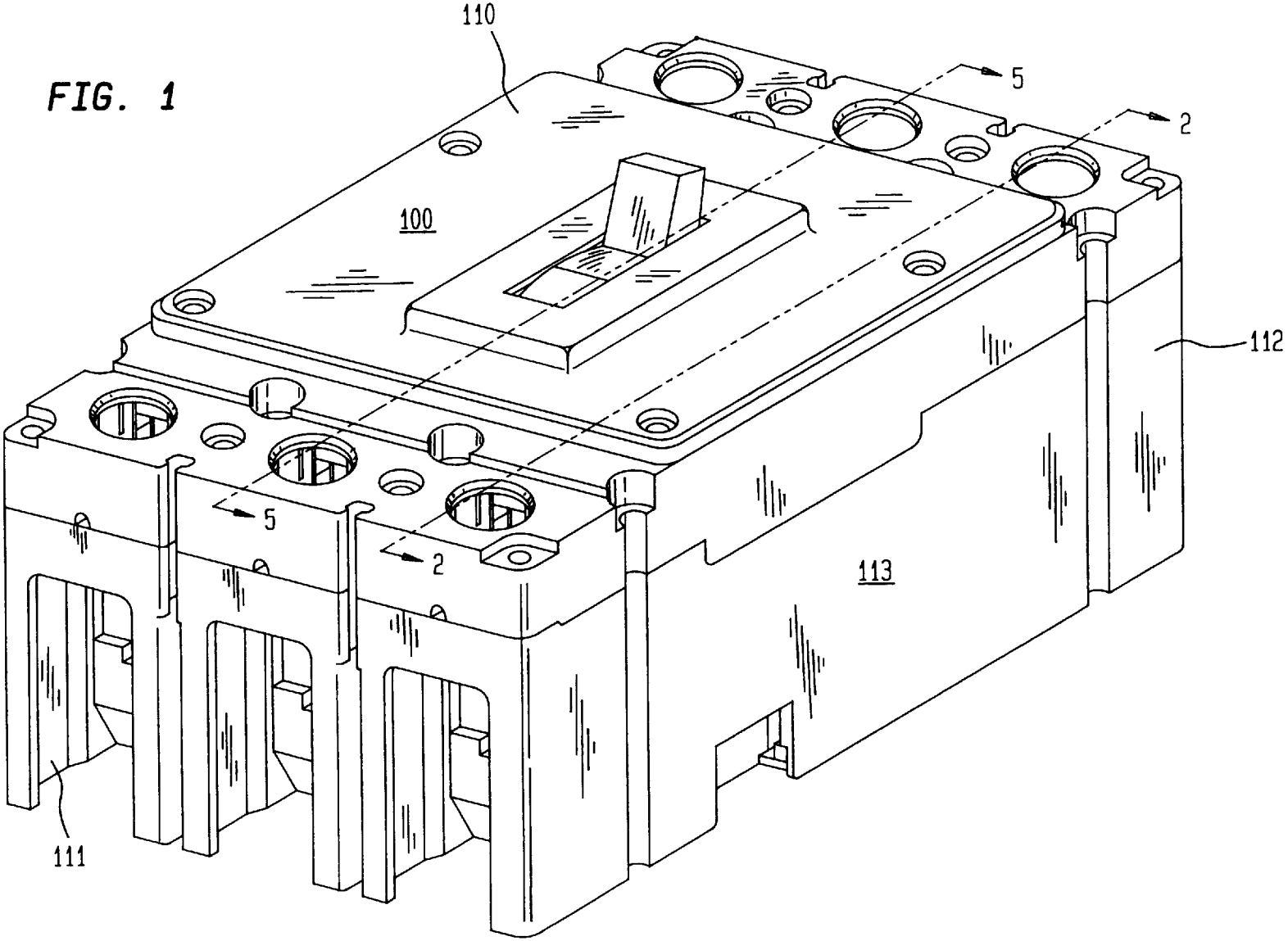
FIG. 1 is an isometric drawing of a circuit breaker which includes an embodiment of the invention.

FIG. 1 is an isometric drawing of a circuit breaker 100 which includes an embodiment of the present invention. The breaker 100 includes a cover 110 which is attached over a base 112 and a subbase (not shown in FIG. 1) which is inserted into the bottom of the base 112. The base 112 of the breaker has two side walls 113 and 111 on opposite sides of the breaker 100.

Figure 2:
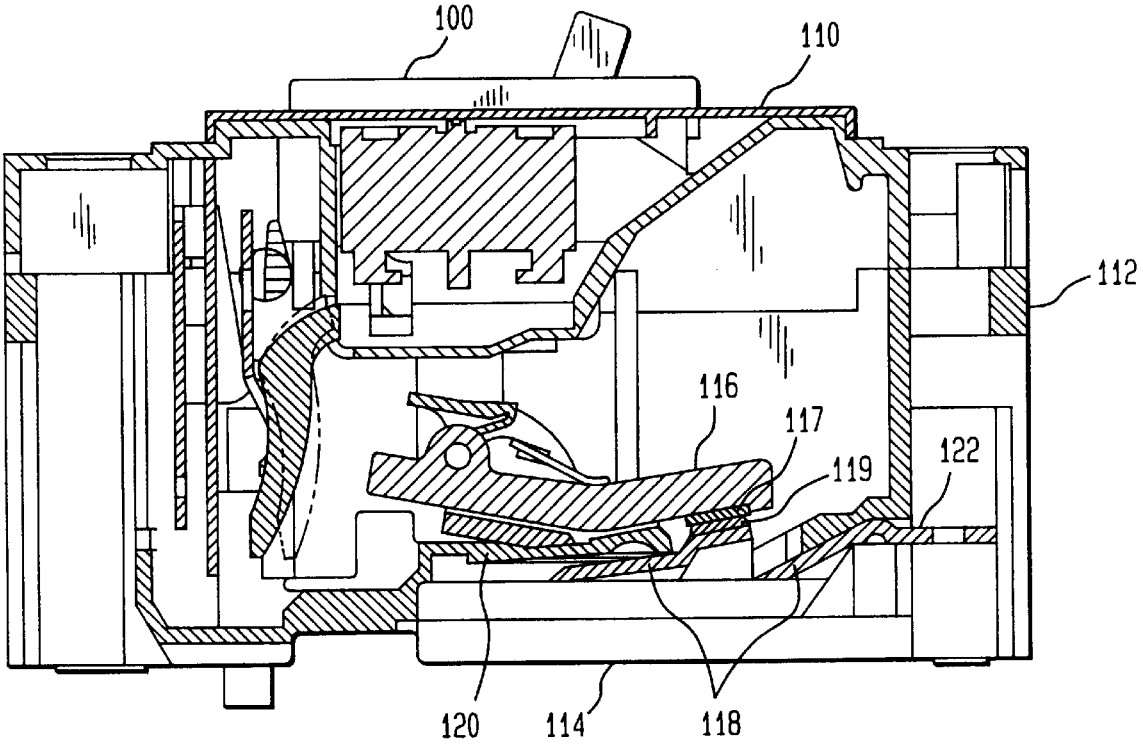
FIG. 2 is a sectional drawing of the circuit breaker shown in FIG. 1 along the lines 2—2.

FIG. 2 is a sectional view of the breaker 100 taken along the rightmost pole, lines 2—2 of FIG. 1. This drawing shows the cover 110, base 112 and subbase 114. Assembled onto the subbase 114 is a fixed line strap 118 which includes a line contact 119. Attached to the base is a movable load contact arm 116 which includes a load contact 117. The base also includes a bottom wall 120 which separates the load contact arm 116 from the line strap 118. The base may be made, for example, from glass filled polyester such that the bottom wall 120 forms an electrically insulating barrier between the load contact arm 116 and the line strap 118. This insulating barrier formed by the bottom wall 120 replaces separate insulators which are needed in existing breakers to separate the load contact arm from the line strap and thus, simplifies the assembly of the breaker 100 by reducing the number of parts and making the breaker easier to assemble.

In addition to insulating the load contact arm 116 and line strap 118, the bottom wall 120 of the base extends into and out of the page as shown in FIG. 2 between the two side walls 111 and 113 of the breaker to form a structural tie which joins the two sides of the circuit breaker. This tie strengthens the base as a rigid member extending across the base at a level approximately one-third of the height of the base. In addition, the subbase 114 is inserted within the bottom of the circuit breaker 100. Thus, the side walls of the base 112 extend around the subbase 114. The horizontal tie formed by the bottom wall 120 of the base combined with the bottom wall of the breaker 100, formed by the subbase 114, and the top wall of the breaker, formed by the upper wall of the cover 110, provide three rigid side-to-side supports for the assembled circuit breaker 100. Because one of these ties, the bottom wall 120 of the base 112, is a part of the molded base, pressure exerted against the side walls of the base is unlikely to deform the base or cause cracks to appear between the base and the cover when the breaker is subject to high-current short circuit conditions.

Also shown in FIG. 2 is the line terminal 122. As described below with reference to FIG. 5, the breaker is assembled by placing the line straps 118 on top of the subbase 114 and then inserting the subbase into a pocket on the bottom of the base 112. Thus, there are no openings in the molded base for the line terminals 122 which need to be cleared before the molded part may be used and there is no need to thread the line terminals 122 through openings in the base 112. This configuration of the subbase 114 and base 112 also simplifies the assembly of the circuit breaker 100.

Figure 3:
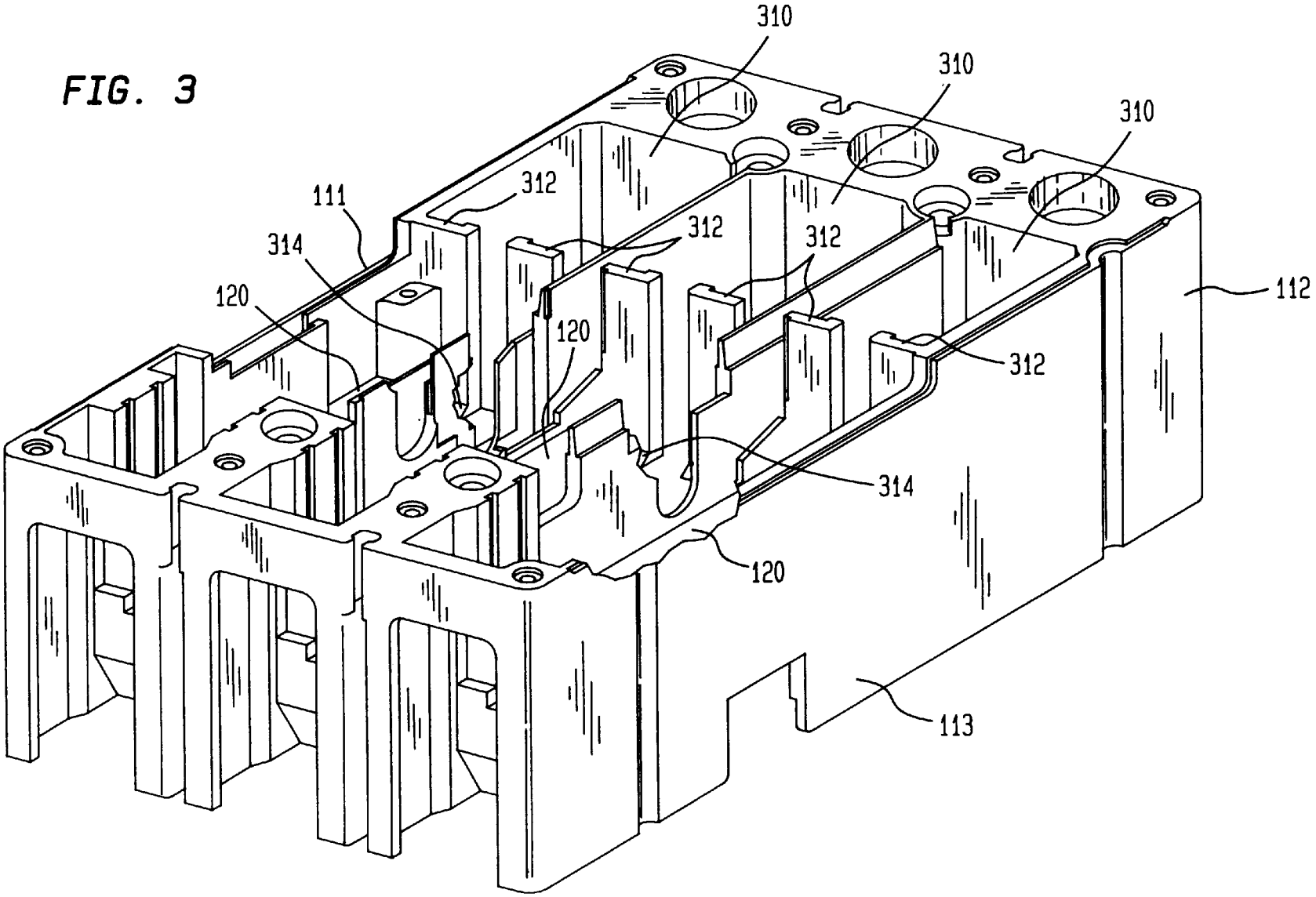
FIG. 3 is a top-view isometric drawing of the base section of the circuit breaker shown in FIG. 1.

FIG. 3 is an isometric top-view of the base 112 which is useful for describing its structural features. The base shown in FIG. 3 is for a three-phase breaker. It includes three similar chambers, one for each phase. Each chamber includes an arc chamber pocket 310 and a subchamber 314 which holds the breaker mechanism and load conductors (neither of which is shown in FIG. 3). The floor of the subchamber 314 is the bottom wall 120 of the base 112. Separating the arc chamber pocket 310 from the mechanical and load conductor area are vertical ribs 312 which are integrally molded with the circuit breaker base 112.

The arc chamber pocket 310 of the assembled breaker includes a series of arc grids (not shown) along its side walls which are designed to quickly dissipate electrical arcs that may form when the breaker contacts 117 and 119 (shown in FIG. 2) are opened. These arcs may form, for example, when a short circuit condition causes the breaker to "blow open" the load and line contacts. In this instance, the current flowing through the breaker generates an electrical arc as the contacts are separated. This arc rapidly heats the air within the breaker resulting in an explosive rise in pressure. In addition, the arc ionizes the air in the arc chamber allowing current to flow through the breaker, albeit at reduced levels, even after the line and load contacts have been separated. This residual current flow heats the air within the breaker, causing a further rise in the internal pressure. The grids in the arc chamber 310 ensure that the energy released in the arc dissipates completely in the arc chamber.

The ribs 312 which separate the arc chamber 310 from the mechanical and load conductor area 314, serve to strengthen the breaker by providing vertical supports.

These ribs 312 as well as the tying brace formed by the bottom wall 120 of the base 112 allow the breaker to withstand relatively large internal forces such as 1) the rapid pressure increases resulting from arcing in the arc chamber, 2) the magnetic blow-open repulsive force and 3) repetitive smaller forces, such as the forces to which the breaker is subject due to repeated switching of the breaker between the open and closed positions. In addition, the supports allow the breaker base 112 to withstand externally generated forces, such as may result in shipping or in handling before the breakers are installed.

Figure 4:
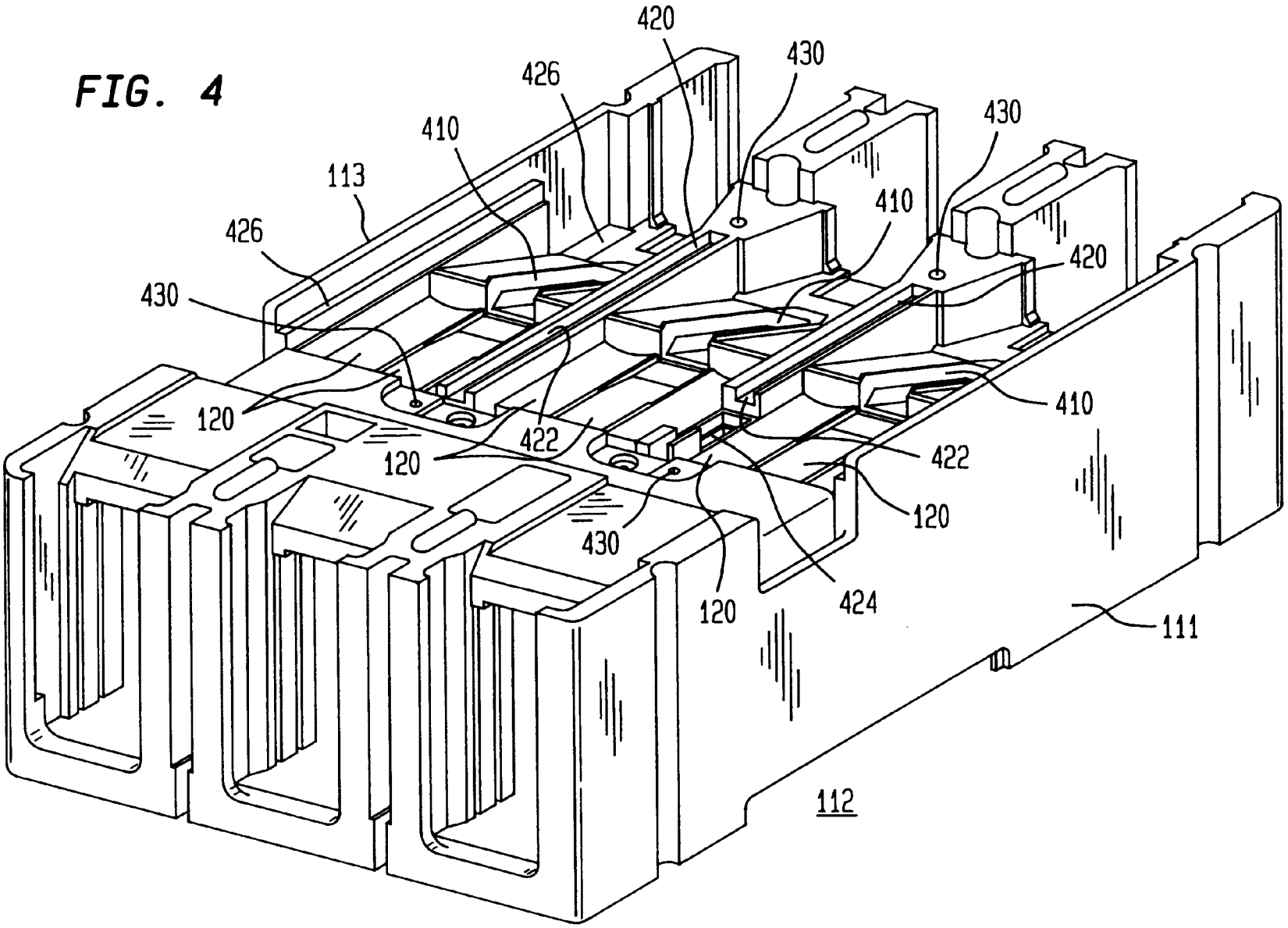
FIG. 4 is a bottom-view isometric drawing of the base section of the circuit breaker shown in FIG. 1.

FIG. 4 is an isometric drawing showing the bottom of the base 112. As shown in FIG. 4, the bottom wall 120 of the base extends across the floor of the mechanical and load conductor areas 314 (shown in FIG. 3). The base 112 also includes three openings, 410 through which the line strap contacts 119 and load blade contacts 117 may be engaged by the breaker mechanism. These openings 410 are located at the bottom of the arc chamber pockets 310.

The bottom of the base 112 also includes ribs 420 which have grooves 422 on their outer edges into which, ribs in the subbase are inserted to form insulating walls between the three line straps 118. One of the ribs 420 includes a gap 424 through which a protruding member on the subbase (described below with reference to FIG. 5) is inserted.

The base 112 shown in FIG. 4 also includes a shelf 426 along the inside of the side walls 111 and 113 and at the back end of the bottom wall 120 of the base. This shelf 426 makes contact with the subbase 114 when it is inserted into the base. The shelf in the base follows the exterior contours of the subbase so that the subbase 114 fits snugly into the base 112. The shelf provides mechanical support for the combination of the base 112 and subbase 114. Because the subbase 114 is inserted into the base 112, the walls of the base form an insulating barrier which encloses the line straps 118. Mounting holes 430 may be used to receive screws which secure the subbase to the base.

Figure 5:
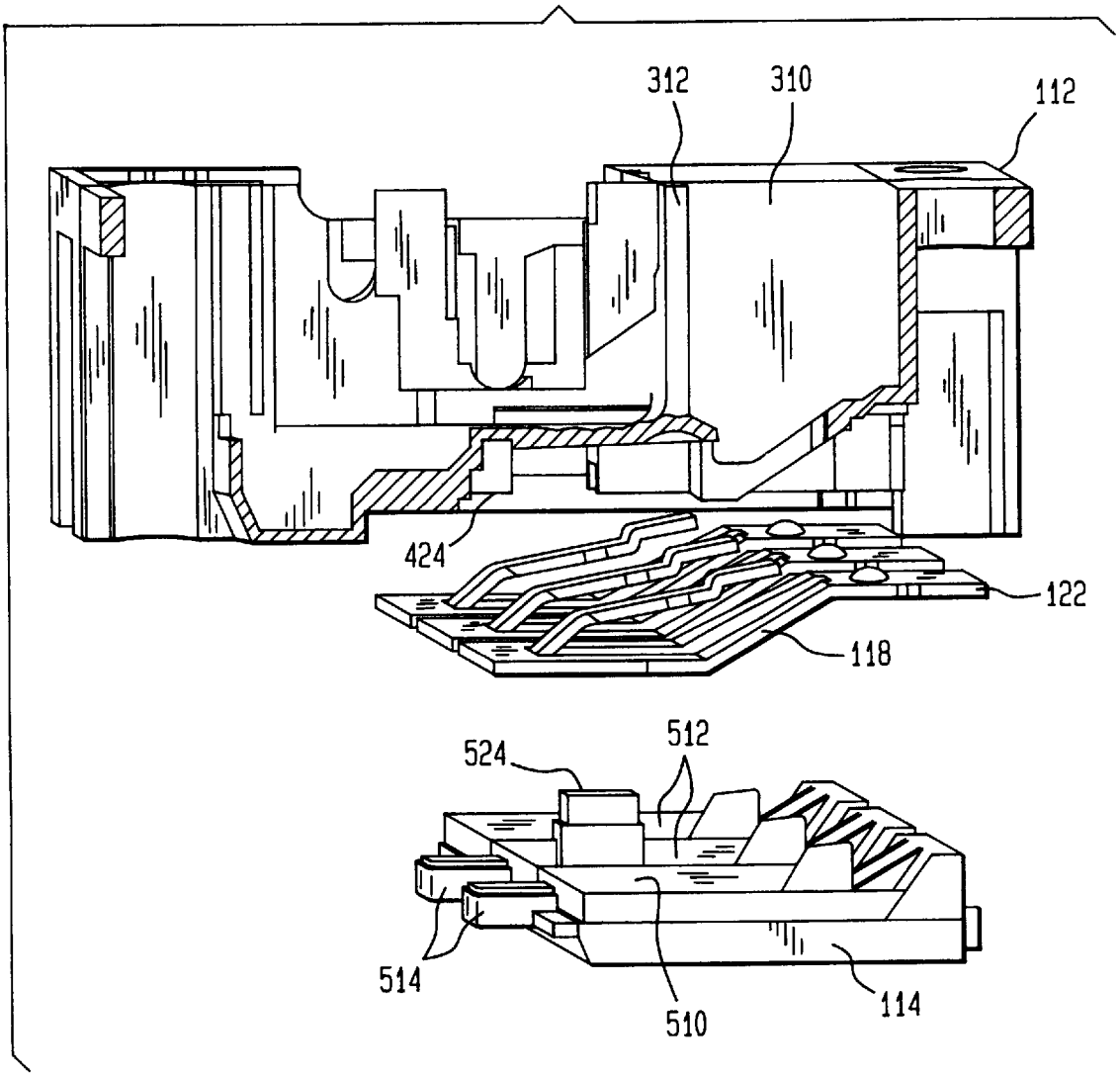
FIG. 5 is an exploded isometric drawing of the base, line straps and subbase of the circuit breaker shown in FIG. 1 including a partial sectional view of the base along lines 5—5 of FIG. 1.

FIG. 5 is an exploded view of the base 112, line straps 118 and subbase 114. As shown in FIG. 5, the subbase includes ribs 512 which fit into the grooves 422 on the ends of the corresponding ribs 420 (shown in FIG. 4) of the base 412. In addition, the subbase includes a projection 524 which mates with the opening 424 (shown in FIG. 4) in the base 112. The subbase includes a total of four screw holes which may be used to secure the subbase to the base. Two of these screw holes 514 are shown in FIG. 5. The remaining screw holes are proximate to the line terminals 122 of the line straps and are not visible in the isometric drawing of the subbase shown in FIG. 5. These screws attach the subbase to the base via the mounting holes 430 shown in FIG. 4.

Although, in the exemplary embodiment of the invention, the subbase 114 is attached to the base 112 by screws, it is contemplated that the base and subbase may be attached by screws, an adhesive, such as epoxy, by a combination of screws and adhesive or by other methods. Where adhesive is used to attach the subbase 114 to the base 112, it may be applied around the exterior of the subbase 114 to attach the outer edge of the subbase to the shelf 426 and grooves 422 which couple the outer rim of the subbase 114 to the base 112. Alternatively, the adhesive may be applied to the shelf 426 and all of the grooves 422 in order to attach the subbase securely to the base. The combined use of screws and adhesives may provide significant advantages where the breaker may interrupt relatively large currents and, thus, may be subject to large changes in internal pressure.

Figure 6:
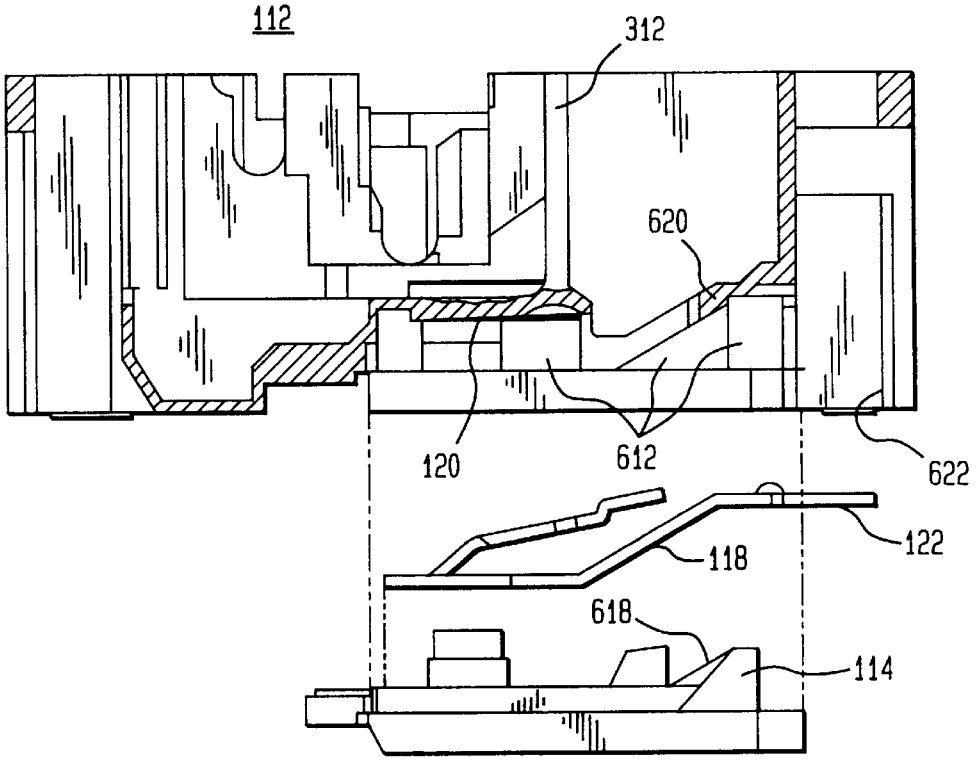
FIG. 6 is a side plan view corresponding to the exploded drawing shown in FIG. 5.

FIG. 6 is an exploded side-plan view corresponding to the exploded isometric vies of the breaker 100 shown in FIG. 5. FIG. 6 includes a sectional view of the base 112 taken along the lines 5—5 shown in FIG. 1. This side plan view illustrates strengthening members 312 and 120 which have been added as a result of the two-piece base design. FIG. 6 also shows the areas of the base into which the line strap 118 is inserted and the projection 618 on the subbase 114 which mates with the wall 620 of the base 112 to form a channel 612 through which the line terminal is accessible from the opening 622 in the base 112 of the circuit breaker 100.

Figure 7:
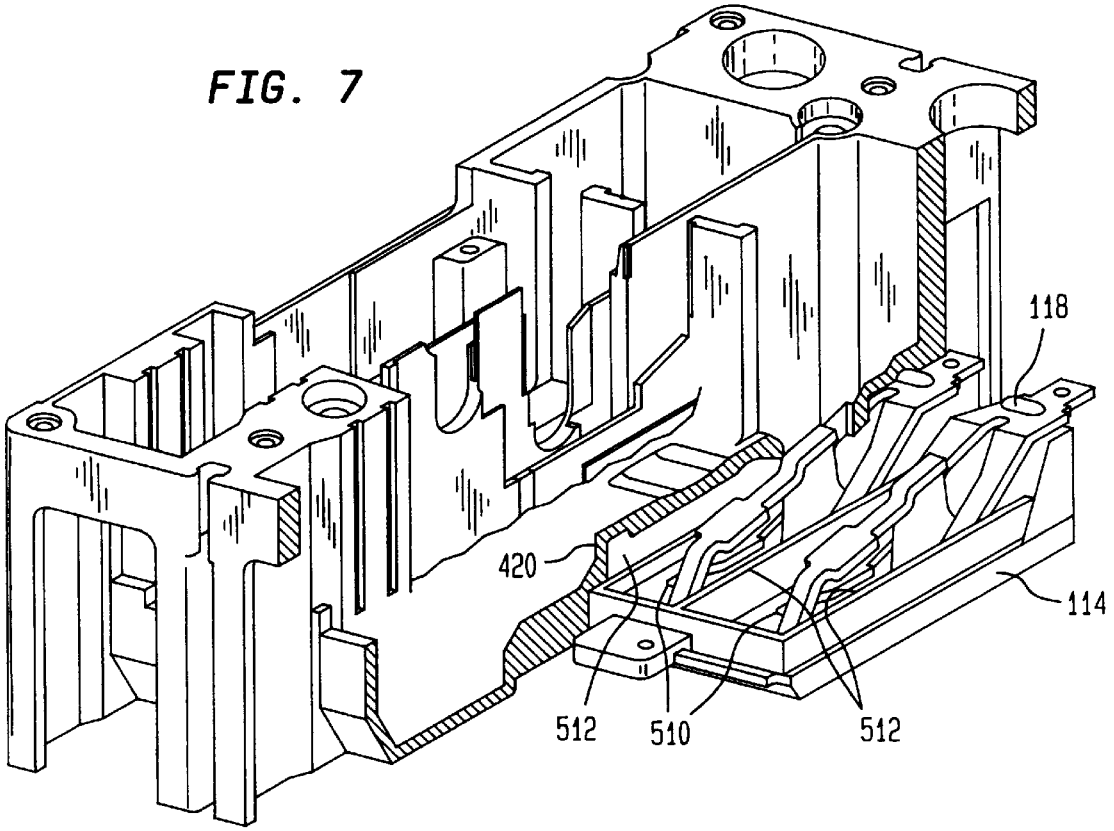
FIG. 7 is an isometric drawing of the assembled base, line straps and subbase including a partial sectional view of the base along lines 5—5 of FIG. 1.

FIG. 7 is an isometric drawing of the assembled breaker 100 with the base cut away along the lines 5—5 of FIG. 1. This Figure shows the line straps 118 inserted into the line strap pockets 510 of the subbase 114. It also shows the ribs 512 which form the sides of the line strap pockets 510 and which engage the grooves 422 in the ribs 420 that project down from the bottom of the base 112.

Figure 8:
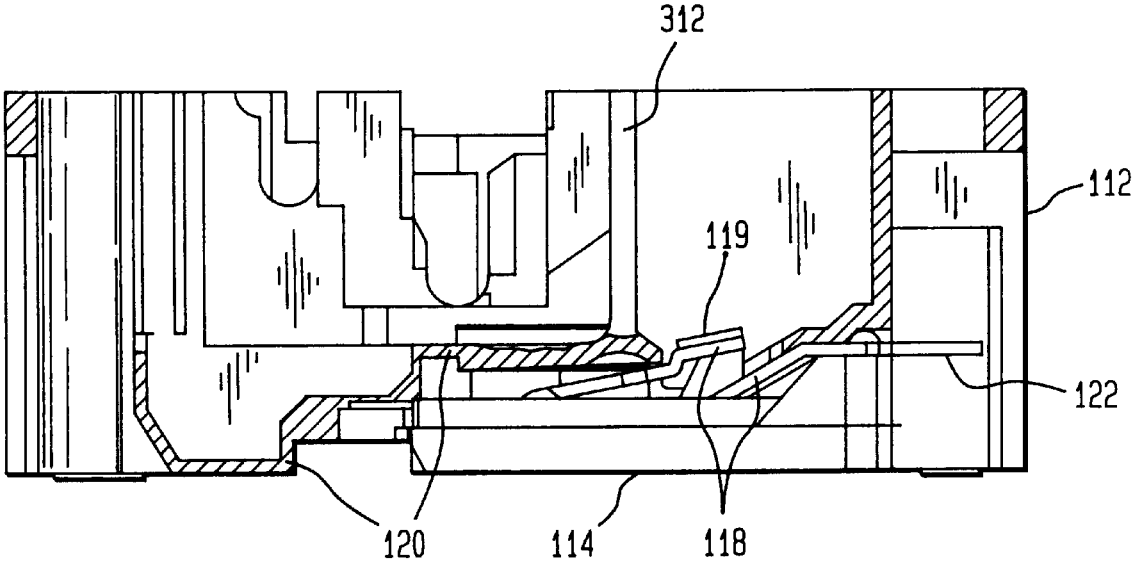
FIG. 8 is a side plan view corresponding to the isometric drawing shown in FIG. 7.

FIG. 8 is a side plan view corresponding to the isometric drawing shown in FIG. 7. This drawing illustrates the assembled base 112 and subbase 114 before the load contact arms and mechanical structure are inserted into the base. FIG. 8 shows the structural relationship between the bottom wall 120 of the base and the vertical rib 312. The rib 312 is located near the opening 420 in the base 112 to reinforce the bottom wall 120 proximate to the opening 420. The right angles formed by the junction of the bottom wall 120 and the vertical ribs 312 significantly strengthen the base 100, allowing it to withstand greater internal and external stresses than a base having a more open one-piece design.

While the invention has been defmed in terms of an exemplary embodiment, it is contemplated that it may be practiced with variations within the scope of the appended claims.

What is claimed:

1. A circuit breaker housing comprising:

a base including first and second side walls and a bottom wall extending between the first and second side walls and having an opening through which a movable load contact arm projects to make contact with a line contact arm, wherein each of the side walls has an upper end and a lower end, and the bottom wall of the base is interposed between the upper ends and the lower ends of the side walls for forming structural support for the base, the base including at least two vertical ribs formed integrally with the base having lengths substantially the same as the side walls for providing structural support to the base and for defining an opening extending from the bottom wall to form at least one arc chamber pocket, the load contact arm configured to make contact with the line contact arm within the arc chamber pocket; and a sub-base, mechanically coupled to the base, including a pocket into which the line contact arm is inserted such that when the sub-base is coupled to the base, a portion of the line contact arm onto which a line contact may be attached is directly beneath the opening in the bottom wall of the base; wherein:

(a) the bottom wall of the base has an interior surface which is adjacent to the load contact arm, an exterior surface which is adjacent to the line contact arm, and at least two joining ribs extending from the exterior surface, each joining rib abutting one of the two vertical ribs, and each joining rib having a groove extending along a length direction; and (b) the sub-base has at least two further joining ribs extending from an interior surface and extending along the length direction to form the pocket into which the line contact arm is inserted, and one of the further joining ribs engages one groove of the two joining ribs to form an insulating wall adjacent to the line contact arm.

2. A circuit breaker housing according to claim 1, wherein the base further comprises a vertical rib inwardly extending inwardly from the side wall of the base and attached to the bottom wall of the base adjacent to the opening in the bottom wall, wherein the vertical rib attaches the side wall to the bottom wall and structurally strengthens the side wall of the base and the bottom wall of the base proximate to the opening in the bottom wall.

3. A circuit breaker housing according to claim 1, wherein the sub-base is attached to the base by applying an adhesive to the groove and the further joining rib before attaching the sub-base to the base.

4. A circuit breaker housing according to claim 1 wherein the subbase is attached to the base with screws.

5. A circuit breaker housing according to claim 1 wherein the subbase is attached to the base with an adhesive.

6. The circuit breaker housing of claim 1 wherein the bottom wall of the base is interposed at a position located approximately one-third of the length of each side wall away from the lower end of each side wall.

7. A circuit breaker housing comprising:

a sub-base including a pocket into which a line contact arm is inserted; and a base, mechanically coupled to the sub-base, including: first and second side walls;

a bottom wall, extending between the first and second side walls and interposed between respective ends of the side walls for providing structural support for the base, the bottom wall having an opening through which a movable load contact arm projects to make contact with a line contact arm, wherein the bottom wall forms a structural support for the base and provides an electrically insulating barrier between respective portions of the load contact arm and the line contact arm; and at least two vertical ribs extending from the side walls of the base and attached to the bottom wall of the base, the vertical ribs having lengths substantially the same as the side walls for providing structural support to the base and for defining an opening extending from the bottom wall to form at least one arc chamber pocket, the load contact arm configured to make contact with the line contact arm within the arc chamber pocket; wherein:

(a) the bottom wall of the base has an interior surface which is adjacent to the load contact arm, an exterior surface which is adjacent to the line contact arm, and at least two joining ribs extending from the exterior surface, each joining rib abutting one of the two vertical ribs, and each joining rib having a groove extending along a length direction; and (b) the sub-base has at least two further joining ribs extending from an interior surface and extending along the length direction to form the pocket into which the line contact arm is inserted, and at least one of the further joining ribs engages at least one respective groove of the two joining ribs to form an insulating wall adjacent to the line contact arm.

8. A circuit breaker housing according to claim 7 wherein the base has a joining rib extending from an exterior surface of the bottom wall, the joining rib having a groove and the sub-base having a further joining rib, and the sub-base is attached to the base by applying an adhesive to at least one of the groove and the further joining rib before attaching the sub-base to the base.

9. A circuit breaker housing according to claim 8 wherein the subbase is further attached to the base with screws.

10. A circuit breaker housing comprising:

a sub-base including a pocket into which a line contact arm is inserted, wherein the sub-base has an interior surface which includes the line contact arm pocket, and the sub-base includes at least two first joining ribs extending from the interior surface of the bottom wall; and a base, mechanically coupled to the sub-base, including: first and second side walls;

a bottom wall, extending between the first and second side walls, the bottom wall having an opening through which a movable load contact arm projects to make contact with a line contact arm, wherein the bottom wall is interposed between respective ends of the side walls for forming a structural support for the base and providing an electrically insulating barrier between respective portions of the load contact arm and the line contact arm, wherein the bottom wall has an interior surface which is adjacent to the load contact arm and an exterior surface which is adjacent to the line contact arm and base includes at least two second joining ribs extending from the exterior surface of the bottom wall, each second joining rib having a groove such that the first joining rib engages the groove of one of the two second joining ribs to form an insulating wall adjacent to the line contact arm; and at least two vertical ribs extending from the side walls of the base and attached to the bottom wall of the base adjacent to the opening in the bottom wall, wherein the vertical ribs attach the side walls to the bottom wall and structurally strengthen the side walls of the base and the bottom wall of the base proximate to the opening in the bottom wall, the vertical ribs formed integrally with the base extending from the bottom wall and having a length substantially the same as the side walls for providing structural support to the base and for defining an opening extending from the bottom wall and having a length substantially the same as the side walls to form at least one arc chamber pocket, the load contact arm configured to make contact with the line contact arm within the arc chamber pocket; wherein each second joining rib abuts a respective one of the two vertical ribs.

11. A circuit breaker housing according to claim 10 wherein the subbase is attached to the base with screws.

12. A circuit breaker housing according to claim 11 wherein the subbase is attached to the base with an adhesive.

13. A circuit breaker housing comprising:

a base including first and second side walls and a bottom wall, extending between the first and second side walls and having an opening through which a movable load contact arm projects to make contact with a line contact arm, wherein the bottom wall is interposed between respective ends of the side walls to form a structural support for the base, the base including at least two vertical ribs formed integrally with the base and having lengths substantially the same as the side walls for providing structural support to the base and for defining an opening extending from the bottom wall to form at least one arc chamber pocket;

the base including at least two joining ribs extending from an exterior surface of the bottom wall, each joining rib abutting one of the two vertical ribs, and each having a groove extending along a length direction; and a sub-base, mechanically coupled to the base, including a pocket into which the line contact arm is inserted such that when the sub-base is coupled to the base, a portion of the line contact arm onto which a line contact may be attached is directly beneath the opening in the bottom wall of the base;

the sub-base having at least two further joining ribs extending from a bottom wall of the sub-base and along the length direction to form the pocket into which the line contact arm is inserted, and one of the further joining ribs engaging the groove of one of the joining ribs to form an insulating wall adjacent to the line contact arm.

14. A circuit breaker housing comprising:

a base including (a) first and second side walls, (b) a bottom wall extending between the first and second side walls and interposed between respective ends of the side walls, the bottom wall having interior and exterior surfaces, (c) at least two vertical ribs extending from the bottom wall in a direction away from both, the interior and exterior surfaces, and (d) at least two joining ribs extending from the exterior surface of the bottom wall, each joining rib abutting one of the two vertical ribs, and each having a groove extending along a length direction; and a sub-base, mechanically coupled to the base, including at least two further joining ribs extending from a bottom wall of the sub-base and along the length direction, and one of the further joining ribs engaging the groove of one of the joining ribs to form an insulating wall, wherein the bottom wall of the base, the joining ribs, the further joining ribs and the vertical ribs provide structural support to the base and the subbase.

15. A circuit breaker housing comprising:

a base including first and second side walls and a bottom wall extending between the first and second side walls and having an opening through which a movable load contact arm projects to make contact with a line contact arm, wherein each of the side walls has an upper end and a lower end, and the bottom wall of the base is interposed between the upper ends and the lower ends of the side walls for forming structural support for the base, a sub-base, mechanically coupled to the base, including a pocket into which the line contact arm is inserted such that when the sub-base is coupled to the base, a portion of the line contact arm onto which a line contact may be attached is directly beneath the opening in the bottom wall of the base.

16. A method of assembly of a circuit breaker comprising the steps of:

(a) forming a base having side walls and a bottom wall including an opening, the bottom wall having an interior surface and an exterior surface;

(b) integrally forming with the base at least two vertical ribs, both extending from the interior surface and the exterior surface to define an arc-chamber pocket;

(c) integrally forming with the base at least two joining ribs extending from the exterior surface and abutting at least one of the two vertical ribs;

(d) forming a sub-base for coupling to the base including a further bottom wall;

(e) integrally forming with the sub-base at least two further joining ribs extending from the further bottom wall to define a pocket; and (f) joining the base with the sub-base so that the two joining ribs engage the two further joining ribs to form extensions to the side walls.

17. The method of claim 16 including the following additional steps:

(g) inserting a line contact arm in the pocket of the sub-base after step (e);

(h) inserting a load contact arm in the arc-chamber pocket after step (c); and wherein the line contact arm projects through the opening and makes contact with the load contact arm within the arc-chamber pocket after step (f).

* * * * *